US005131888A

United States Patent [19]

Adkins, II

[11] Patent Number: 5,131,888

[45] Date of Patent: Jul. 21, 1992

[54] SOLAR POWERED EXHAUST FAN

[76] Inventor: Dwight O. Adkins, II, 4610 Eubank, NE., #802, Albuquerque, N. Mex. 87111

[21] Appl. No.: 690,673

[22] Filed: Apr. 24, 1991

[51] Int. Cl.[5] ..... F24F 7/007

[52] U.S. Cl. ..... 454/343; 454/354; 454/355; 454/900

[58] Field of Search ..... 98/42.02, 42.04, 42.07, 98/42.11, 900

[56] References Cited

U.S. PATENT DOCUMENTS

| | | | |
|---|---|---|---|
| 2,157,609 | 5/1939 | Hopkins | 98/42.07 X |
| 2,630,056 | 3/1953 | Glascock | 98/42.07 |
| 2,828,682 | 4/1958 | Marker | 98/42.07 |
| 3,520,245 | 7/1970 | Painter | 98/42.01 X |
| 4,432,273 | 2/1984 | Devitt | 98/900 X |
| 4,800,803 | 1/1989 | Farmont | 98/2.14 |
| 4,899,645 | 2/1990 | Wolfe et al. | 98/2.02 |
| 4,905,579 | 3/1990 | Dame | 98/900 X |
| 4,939,986 | 7/1990 | Turner | 98/42.1 |
| 4,942,806 | 7/1990 | Hwang | 98/2.02 |

FOREIGN PATENT DOCUMENTS

| | | | |
|---|---|---|---|
| 280338 | 12/1986 | Japan | 98/42.11 |

*Primary Examiner*—Harold Joyce
*Attorney, Agent, or Firm*—Donovan F. Duggan; Deborah A. Peacock

[57] ABSTRACT

A solar powered exhaust fan having a pipe adaptor for connection to the interior of portable buildings. The exhaust fan may be either DC or AC energized. Automatic and manual switches are provided.

19 Claims, 1 Drawing Sheet

SOLAR POWERED EXHAUST FAN

BACKGROUND OF THE INVENTION

1. Field of the Invention (Technical Field)

This invention relates to solar powered portable exhaust fans, and particularly to such fans as modular units attachable to small buildings, such as portable toilets and the like.

2. Background Art

U.S. Pat. No. 4,939,986, to Turner, entitled Exhaust Ventilator, teaches a solar powered exhaust ventilator, but it is not a modular self-contained unit having a pipe adaptor. U.S. Pat. No. 4,432,273, to Devitt, entitled Fan Powered Roof Venting Method and Apparatus, discloses a roof venting apparatus which appears modular in structure, but lacks a translucent cover and internally disposed solar power unit, as well as pipe adaptor structure.

Various ventilation devices for vehicles exist in the prior art. U.S. Pat. No. 4,800,803, to Farmont, entitled Ventilation Device, discloses a ventilation device attachable to a vehicle sun roof. U.S. Pat. No. 4,942,806, to Hwang, entitled Vehicular Internal Air Exhausting Device, likewise teaches a vehicular ventilating device, in this instance, mounted behind the rear seat. The solar powered ventilator disclosed in U.S. Pat. No. 4,899,645, to Wolfe, et al., entitled Solar Powered Ventilator, is an "edge mounted" device suitable for mounting on vehicle or building windows. All of these patents, for the most part intended for vehicular use, are not designed for small stationary structure use.

SUMMARY OF THE INVENTION (Disclosure of the Invention)

The present invention relates to a solar powered exhaust fan comprising a support structure having an aperture, an exhaust fan mounted on the support structure, a solar power collector for powering the exhaust fan, a pipe adaptor attached to the exhaust fan, and an exhaust pipe attached to the exhaust fan. In a preferred embodiment of the invention, the solar power collector comprises a solar cell panel, the support structure further comprises a transparent or translucent cover mounted thereon, the pipe adaptor extends downwardly through the aperture in the support structure, and the exhaust pipe extends upwardly from the exhaust fan. The invention may further comprise a manually or solar-actuated switch for actuating the exhaust fan. The pipe adaptor may be further connected to a vent pipe, which may extend through the transparent or translucent cover which covers the exhaust fan assembly.

The present invention additionally relates to a modular solar powered exhaust fan for portable buildings, such as portable toilets and the like, comprising a support structure, a solar power source mounted on the support stucture, an exhaust fan mounted on the support stucture, and a transparent or translucent cover shielding the modular solar powered exhaust fan assembly while allowing activation of the solar power source. In a preferred embodiment of the invention, the support structure comprises an attachment structure, for example a strap, for attaching the modular solar powered exhaust fan assembly to a building. The support structure may comprise an aperture corresponding to an opening in the roof of the building. The invention may additionally comprise a pipe adaptor extending downwardly through the aperture and the opening in the roof of the building, a battery and circuit board connected to the solar power source, and a manually or solar-actuated switch for activating the exhaust fan. The exhaust fan may further comprise a variable speed DC motor, and the transparent or translucent cover may be removably attachable to the support structure and may comprise PLEXIGLAS®, LEXAN®, or LUCITE®.

The present invention also relates to a modular solar powered exhaust fan for portable buildings comprising a support plate, a solar cell mounted upon the support plate, a power source assembly electrically connected to the solar cell, an exhaust fan assembly mounted on the support plate, a pipe adaptor secured to the exhaust fan assembly, an exhaust structure secured to the exhaust fan assembly, and a translucent or transparent cover through which the exhaust structure extends.

A primary object of the invention is to provide a solar exhaust fan which is portable and modular in construction.

Another objects of the invention is to provide a solar exhaust fan which is inexpensive and easy to fabricate.

Yet another object of the invention is to provide a solar exhaust fan which can power direct current (DC) or alternating current (AC) fans.

An advantage of the present invention is its ease of installation.

Yet another advantage of the present invention is both manual and automatic operation.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DESCRIPTION OF THE PREFERRED EMBODIMENT (Best Mode for Carrying out the Invention)

Figure 1:
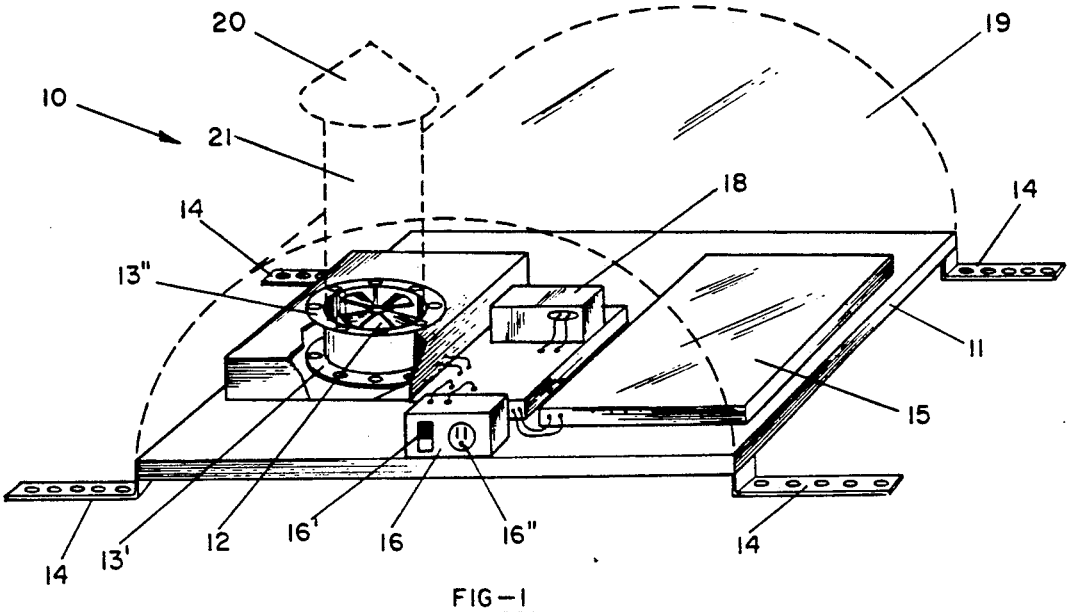
FIG. 1 is a side perspective view of the preferred embodiment of the invention.
Figure 2:
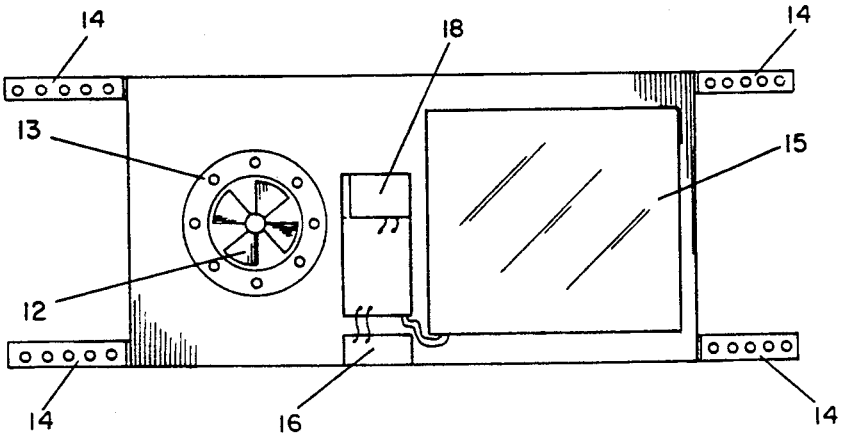
FIG. 2 is a top view of the preferred embodiment of the invention.
Figure 3:
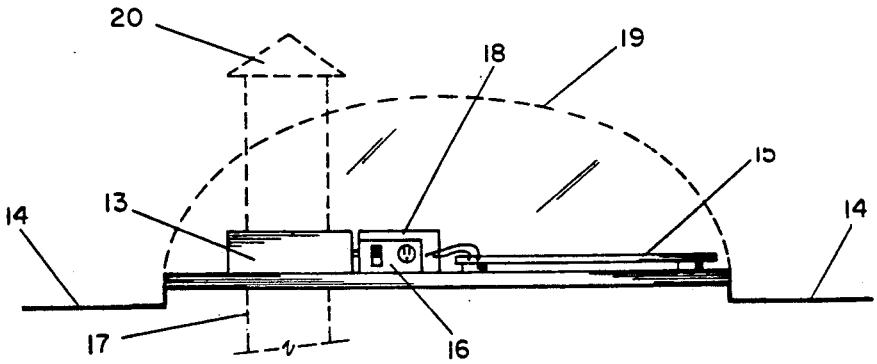
FIG. 3 is a side view of the preferred embodiment of the invention.

Reference is now made to FIGS. 1–3, which show the preferred embodiment of the invention. Modular solar powered exhaust fan assembly 10, adapted for mounting upon a building, such as a portable toilet, outhouse, or the like (not shown), comprises planar support plate 11. Planar support plate 11 provides support for all elements of modular exhaust fan assembly 10. Support plate 11 further comprises an aperture for pipe adaptor 17 to extend therethrough into the interior of the building.

Pipe adaptor 17 provides connection to conduits or pipes for transporting stale air and noisome odors from the building interior. Alternatively, pipe adaptor 17 provides venting capacity when appropriately connected to plumbing. Pipe adaptor 17 is connected to lower flange 13' on exhaust fan housing 13 by means well known in the art, such as bolts, screws, welding, and the like. Pipe adaptor 17 preferably comprises a plastic composition, for example, polyvinyl chloride, polycarbonate, polyvinyl acetate, polyurethane, and the like.

Support plate 11 further comprises strap 14 providing a mounting attachment to the building. Strap 14 may be perforated to provide attachment to the building roof by screws, bolts, nails, and other means well known in the art.

Support plate 11 further provides for the exhaust fan assembly mounted thereon by any well known means. The exhaust fan assembly comprises exhaust fan 12 and exhaust fan housing 13. Upper and lower flanges 13", 13', respectively, are integrally formed with exhaust fan housing 13.

Exhaust fan 12 preferably comprises a variable speed fractional horsepower DC motor with a bladed output shaft. Examples of such motors are DAYTON ® and SUNON ®, manufactured by W. W. Grainger, Inc.; obviously other motors may be suitable. Alternatively, AC motors may be used, depending upon size, alternating current availability, motor control requirements, and power considerations.

Solar cell panel 15 is also mounted upon support plate 11. Solar cell panel 15 may comprise a plurality of solar cells in an array, or a single solar collector, such as manufactured by Arco Solar of Camarillo, Calif., for example. Panel 15 provides charging current to battery and circuit board assembly 18. Battery and circuit board assembly 18, in turn, powers exhaust fan 12 and provides DC to switch assembly and converter 16.

Switch assembly and converter 16 comprises on-off switch 16' and AC outlet 16". Switch assembly and converter 16 also comprises a DC-to-AC converter for providing AC to outlet 16". Switch assembly 16' and converter 16 may alternatively be mounted within the building or at other suitable locations.

Battery and circuit board assembly 18 comprises a 12 V DC battery, together with motor control elements, such as resistors, capacitors, and the like, mounted on a circuit board. The circuit board also mounts a thermal, solar, or other environmental or weather-sensitive switch. Such switch may be set to be actuated by any desired condition, such as temperature or humidity. Exhaust fan 12 is thereby energized.

A manual switch (not shown) is also provided on or within the building mounting the solar powered exhaust fan module to provide user control.

Exhaust fan housing 13 is further connected to exhaust pipe 21. Upper flange means 13" is secured to exhaust pipe 21 by means well known in the art, including screws, bolts, welding, and the like. Exhaust pipe 21 extends through cover 19 and is itself shielded from precipitation by hood 20.

Cover 19 comprises translucent, or preferably transparent, material such as PLEXIGLAS ®, LUCITE ®, or LEXAN ®. Cover 19 is either detachably or permanently secured to support plate 11 depending upon the application or intended use of the solar powered exhaust fan. Detachable securing means comprising press-fitting, screws, bolting, or other means well known in the art, could be utilized. Permanent securing means comprising screws, bolts, ultrasonic welding, and other means well known in the art could also be used. Cover 19 provides protection for the various components of the solar powered exhaust fan while permitting passage of light to energize solar panel 15. If transparent, cover 19 additionally provides a visual inspection capability for the module.

In operation, solar panel 15 is normally operative to charge battery (and circuit board) 18 during daylight hours. Depending upon the preset conditions, the thermal or weather-sensitive switch will energize exhaust fan 12 accordingly. Users of the building may actuate exhaust fan 12 by actuating the manual switch.

Although the invention has been described with reference to these preferred embodiments, other embodiments can achieve the same results. Variations and modifications of the present invention will be obvious to those skilled in the art and it is intended to cover in the appended claims all such modifications and equivalents.

What is claimed is:

1. A solar powered exhaust fan comprising:
- planar support means having an aperture therein:
- exhaust fan means mounted on said planar support means adjacent said aperture;
- solar power means mounted on said planar support means for powering said exhaust fan means;
- pipe adaptor means attached to said exhaust fan means and extending downwardly therefrom through said aperture; and
- exhaust pipe means attached to said exhaust fan means and extending upwardly therefrom.

2. The invention of claim 1 wherein said solar power means comprises solar cell panel means.

3. The invention of claim 1 wherein said planar support means further comprises transparent or translucent cover means mounted thereon.

4. The invention of claim 1 further comprising solar-actuated switch means for actuating said exhaust fan means.

5. The invention of claim 1 further comprising manually-actuated switch means for actuating said exhaust fan means.

6. The invention of claim 1 wherein said pipe adaptor means is further connected to interior pipe or conduit means.

7. The invention of claim 3 wherein said exhaust pipe means extends through said transparent or translucent cover means.

8. A modular solar powered exhaust fan assembly for portable buildings, such as portable toilets and the like, comprising:
- planar support means;
- solar power means mounted on said planar support means;
- exhaust fan means mounted on said planar support means;
- exhaust pipe means connected to said exhaust fan means; and
- transparent or translucent cover means mounted on said planar support means shielding said modular solar powered exhaust fan assembly while allowing activation of said solar power means.

9. The invention of claim 8 wherein said planar support means comprises attachment means for attaching said modular solar powered exhaust fan assembly to a building structure.

10. The invention of claim 11 wherein said attachment means comprises strap means.

11. The invention of claim 8 wherein said planar support means comprises an aperture corresponding to an opening in the roof of the building structure.

12. The invention of claim 11 further comprising pipe adaptor means extending downwardly through said aperture and the opening in the roof of the building structure.

13. The invention of claim 11 further comprising a battery and circuit board connected to said solar power means.

14. The invention of claim 11 further comprising solar-actuated switch means for activating said exhaust fan means.

15. The invention of claim 11 further comprising manually-actuated switch means for activating said exhaust fan means.

16. The invention of claim 11 wherein said exhaust fan means further comprises variable speed DC motor means.

17. The invention of claim 11 wherein said transparent or translucent cover means is removably attachable to said planar support means.

18. The invention of claim 11 wherein said transparent or translucent cover means comprises a material selected from the group consisting of PLEXIGLAS ®, LEXAN ®, and LUCITE ®.

19. A modular solar powered exhaust fan for portable buildings, such as portable toilets and the like, comprising:

a support plate;

solar cell means mounted upon said support plate;

a power source assembly mounted upon said support plate electrically connected to said solar cell means;

an exhaust fan assembly mounted on said support plate;

pipe adaptor means secured to said exhaust fan assembly and extending downwardly through said support plate;

exhaust means secured to and extending upwardly from said exhaust fan assembly; and a translucent or transparent cover through which said exhaust means extends.

* * * * *